US011248436B2

(12) United States Patent
Graham et al.

(10) Patent No.: US 11,248,436 B2
(45) Date of Patent: Feb. 15, 2022

(54) FRAC DIVERTER

(71) Applicant: SCHLUMBERGER TECHNOLOGY CORPORATION, Sugar Land, TX (US)

(72) Inventors: Robert Matthew Graham, Houston, TX (US); Michael Bilynsky, Houston, TX (US); Roberto Jaime, Houston, TX (US); Christopher Cromer, Houston, TX (US); Sidney J. Jasek, Hallettsville, TX (US); William Norrid, Fulshear, TX (US); Bhushan Pendse, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/634,201

(22) PCT Filed: Jul. 26, 2018

(86) PCT No.: PCT/US2018/043809
§ 371 (c)(1),
(2) Date: Jan. 27, 2020

(87) PCT Pub. No.: WO2019/023413
PCT Pub. Date: Jan. 31, 2019

(65) Prior Publication Data

US 2020/0157914 A1 May 21, 2020

Related U.S. Application Data

(60) Provisional application No. 62/537,263, filed on Jul. 26, 2017.

(51) Int. Cl.
*E21B 33/128* (2006.01)
*E21B 33/129* (2006.01)
(Continued)

(52) U.S. Cl.
CPC ..... *E21B 33/128* (2013.01); *E21B 33/134* (2013.01); *E21B 43/26* (2013.01)

(58) Field of Classification Search
CPC .. E21B 33/128; E21B 33/129; E21B 33/1285; E21B 33/1293; E21B 33/1295; E21B 33/1204
See application file for complete search history.

(56) References Cited

U.S. PATENT DOCUMENTS 4,934,459 A * 6/1990 Baugh ..... E21B 23/01 166/380
7,775,286 B2 8/2010 Duphorne
(Continued)

FOREIGN PATENT DOCUMENTS

CA 2966136 A1 7/2017
WO 2013028800 A2 2/2013
(Continued)

OTHER PUBLICATIONS

International Search Report and Written Opinion issued in the PCT Application PCT/US2018/043809, dated Nov. 23, 2018 (18 pages).
(Continued)

*Primary Examiner* — Kenneth L Thompson
(74) *Attorney, Agent, or Firm* — Matthew Goode

(57) ABSTRACT

A technique facilitates use of a frac diverter instead of a frac plug in a variety of fracturing operations. The frac diverter has a simpler and less expensive construction. Although the frac diverter may not form a seal with the surrounding casing in some applications, the frac diverter is able to sufficiently restrict flow of fracturing fluid to enable a successful fracturing operation. The frac diverter may comprise arrangements of at least one cone, at least one slip ring, and at least one corresponding sub which work in cooperation with a flow restricting element. The flow restricting element may comprise various types of rings, e.g. sealing element rings,
(Continued)

able to sufficiently restrict flow of fracturing fluid past the frac diverter.

23 Claims, 12 Drawing Sheets

(51) Int. Cl.
*E21B 33/134* (2006.01)
*E21B 43/26* (2006.01)

(56) References Cited

U.S. PATENT DOCUMENTS

| | | | | |
|---|---|---|---|---|
| 9,010,411 | B1 | 4/2015 | VanLue | |
| 9,139,928 | B2 | 9/2015 | Mazyar et al. | |
| 9,528,342 | B2 * | 12/2016 | Xu | E21B 33/1293 |
| 9,677,375 | B2 * | 6/2017 | Fitzhugh | E21B 23/06 |
| 9,689,228 | B2 | 6/2017 | VanLue | |
| 9,719,320 | B2 | 8/2017 | VanLue | |
| 9,816,339 | B2 | 11/2017 | Xu | |
| 9,828,828 | B2 | 11/2017 | Doane | |
| 9,856,411 | B2 | 1/2018 | Sadana et al. | |
| 9,926,763 | B2 | 3/2018 | Mazyar et al. | |
| 9,926,766 | B2 | 3/2018 | Xu et al. | |
| 10,000,991 | B2 | 6/2018 | Harris et al. | |
| 10,018,010 | B2 | 7/2018 | King et al. | |
| 10,100,601 | B2 | 10/2018 | King et al. | |
| 10,301,909 | B2 | 5/2019 | McCoy et al. | |
| 10,378,305 | B2 * | 8/2019 | Smith | E21B 29/00 |
| 10,890,045 | B2 * | 1/2021 | Chenault | E21B 33/128 |
| 2012/0145378 | A1 | 6/2012 | Frazier | |
| 2013/0306330 | A1 | 11/2013 | Bishop et al. | |
| 2013/0341049 | A1 | 12/2013 | Roberts | |
| 2016/0040492 | A1 | 2/2016 | Vinson et al. | |
| 2016/0290096 | A1 | 10/2016 | Tse et al. | |
| 2016/0333661 | A1 | 11/2016 | Sallwasser | |
| 2017/0260824 | A1 | 9/2017 | Kellner et al. | |
| 2018/0128073 | A1 | 5/2018 | Frazier | |
| 2019/0055810 | A1 * | 2/2019 | Fripp | A61K 9/0019 |
| 2020/0277831 | A1 * | 9/2020 | Kellner | E21B 23/01 |
| 2021/0140264 | A1 * | 5/2021 | Sommers | E21B 33/13 |

FOREIGN PATENT DOCUMENTS

| | | | |
|---|---|---|---|
| WO | 2016048531 | A1 | 3/2016 |
| WO | 2016085752 | A1 | 6/2016 |
| WO | 2017048305 | A1 | 3/2017 |
| WO | 2017151384 | A1 | 9/2017 |
| WO | 2019023413 | A1 | 1/2019 |
| WO | 2020206196 | A1 | 10/2020 |

OTHER PUBLICATIONS

International Preliminary Report on Patentability issued in the PCT Application PCT/US2018/043809, dated Jan. 28, 2020 (12 pages).
International Search Report and Written Opinion issued in the PCT Application PCT/US2020/026502, dated Jul. 23, 2020 (16 pages).

* cited by examiner

FRAC DIVERTER

CROSS-REFERENCE TO RELATED APPLICATION

The present document is based on and claims priority to U.S. Provisional Application Ser. No. 62/537,263, filed Jul. 26, 2017, which is incorporated herein by reference in its entirety.

BACKGROUND

In a variety of well fracturing applications, a wellbore is initially drilled and cased. A frac plug is then pumped down and actuated to form a seal with the surrounding casing. Once the casing is perforated, the frac plug is used to prevent fracturing fluid from flowing farther downhole, thus forcing the fracturing fluid out through the perforations and into the surrounding formation. In some applications, multiple frac plugs may be deployed to enable fracturing at different well zones. Each frac plug comprises a sealing element which is deformed into sealing engagement with the surrounding casing. The sealing element may be formed of an elastomeric material or metal material which is deformed in a radially outward direction until forming a permanent seal with the inside surface of the casing. To ensure sealing, the frac plug tends to be formed with relatively precise and expensive components. In addition to the expense, the construction of such a frac plug also can lead to difficulties associated with milling out the frac plug after completion of the fracturing operation.

SUMMARY

In general, a system and methodology provide a frac diverter which can be used instead of a frac plug. The frac diverter has a simpler and less expensive construction. Although the frac diverter may not form a complete seal with the surrounding casing in some applications, the frac diverter is able to sufficiently restrict flow of fracturing fluid to enable a successful fracturing operation. According to an embodiment, the frac diverter may comprise arrangements of at least one cone, at least one slip ring, and at least one corresponding sub which work in cooperation with a flow restricting element. The flow restricting element may comprise various types of rings, e.g. sealing ring elements, able to sufficiently restrict flow of fracturing fluid past the frac diverter to enable a fracturing operation even without formation of a seal between the flow restricting element and the surrounding wellbore wall surface. Thus, the frac diverter may be constructed with less expensive components and materials.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for facilitating a fracturing operation. The system and methodology provide a frac diverter, having a relatively simple and inexpensive construction, which can be used instead of a conventional frac plug. Although the frac diverter may not form a seal with the surrounding casing in some applications, the frac diverter is able to sufficiently restrict flow of fracturing fluid to enable a successful fracturing operation.

According to an embodiment, the frac diverter may comprise arrangements of at least one cone, at least one slip ring, and at least one corresponding sub which work in cooperation with a flow restricting element. The flow restricting element may comprise various types of rings able to sufficiently restrict flow of fracturing fluid past the frac diverter. The flow restriction enables a fracturing operation without formation of a seal between the flow restricting element and the surrounding wellbore wall surface. In various embodiments, the frac diverter may be constructed from less expensive components and materials because it enables a successful fracturing operation regardless of whether a seal is formed with the surrounding wellbore wall. In some embodiments, the flow restricting element may comprise a sealing element able to form an incidental, temporary, or long-lasting seal but loss of such seal does not detrimentally affect the corresponding fracturing operation.

Figure 1:
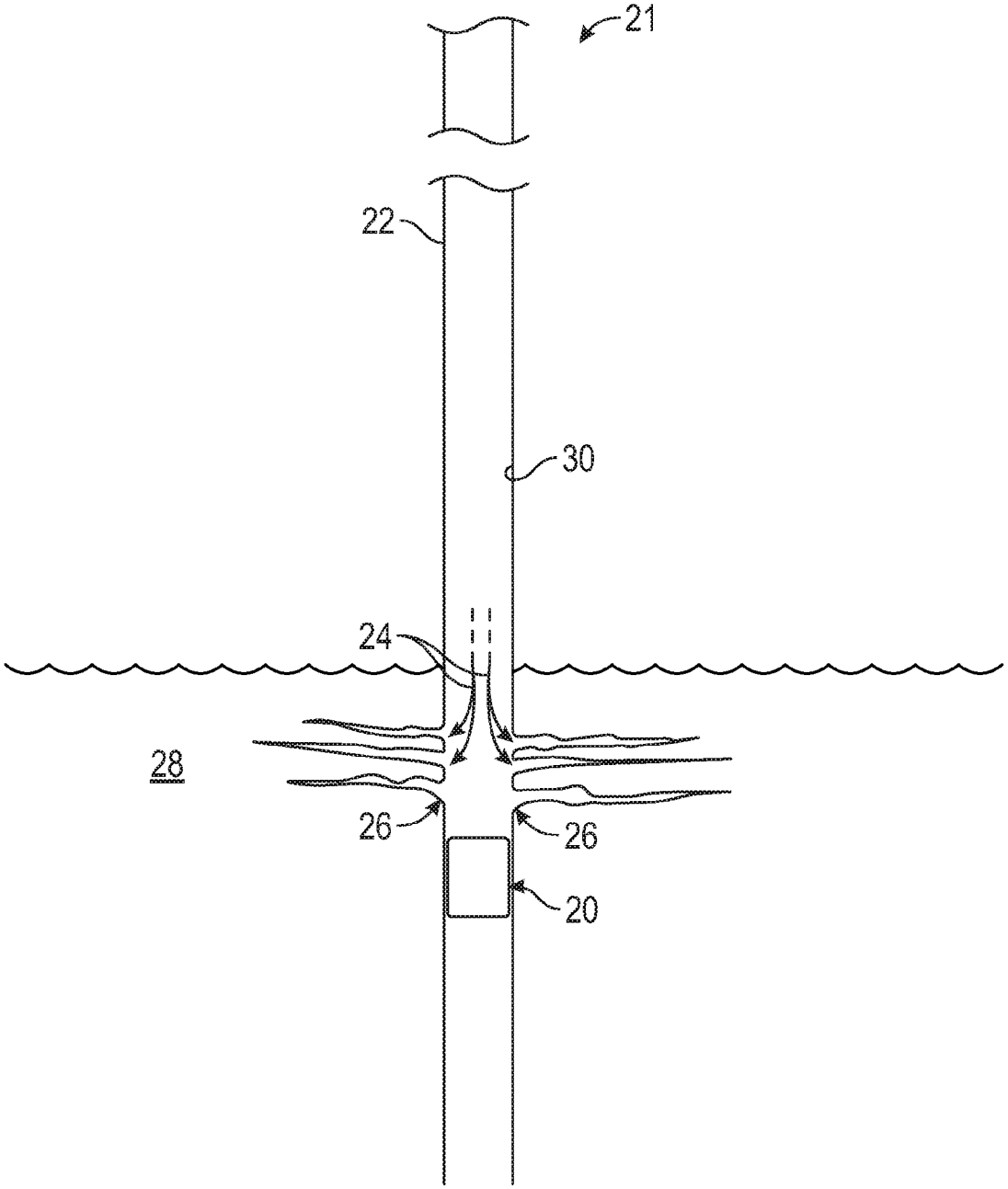
FIG. 1 is a schematic illustration of an example of a frac diverter deployed in a borehole, e.g. a wellbore, according to an embodiment of the disclosure.

Referring generally to FIG. 1, an embodiment of a frac diverter 20 is illustrated as deployed in a well 21. For example, the frac diverter 20 may be deployed in a borehole 22, e.g. a wellbore, to facilitate a fracturing operation. In the example illustrated, the frac diverter 20 is deployed in borehole 22 so as to divert flow of a fracturing fluid 24 through perforations 26 and into a surrounding formation 28 for fracturing of the surrounding formation 28. It should be noted frac diverters 20 may be used in many types of wellbores and are amenable to use in deviated, e.g. horizontal, wellbores to facilitate fracturing of desired well zones along the horizontal or otherwise deviated wellbore.

The borehole 22 may be lined with a casing 30 and each frac diverter 20 may be actuated to a radially expanded position which seals or substantially restricts flow of the fracturing fluid 24 downhole along borehole 22. As a result, the fracturing fluid 24 is diverted out through perforations 26 into the surrounding formation 28. Although the frac diverter 20 may not form a seal with the casing 30, the substantial restriction of flow and consequent diversion of fracturing fluid through perforations 26 enable performance of the fracturing operation without the expense of a conventional frac plug. Once the fracturing operation is completed and a given frac diverter 20 is no longer of use, the frac diverter 20 may be milled and removed from borehole 22.

Figure 2:
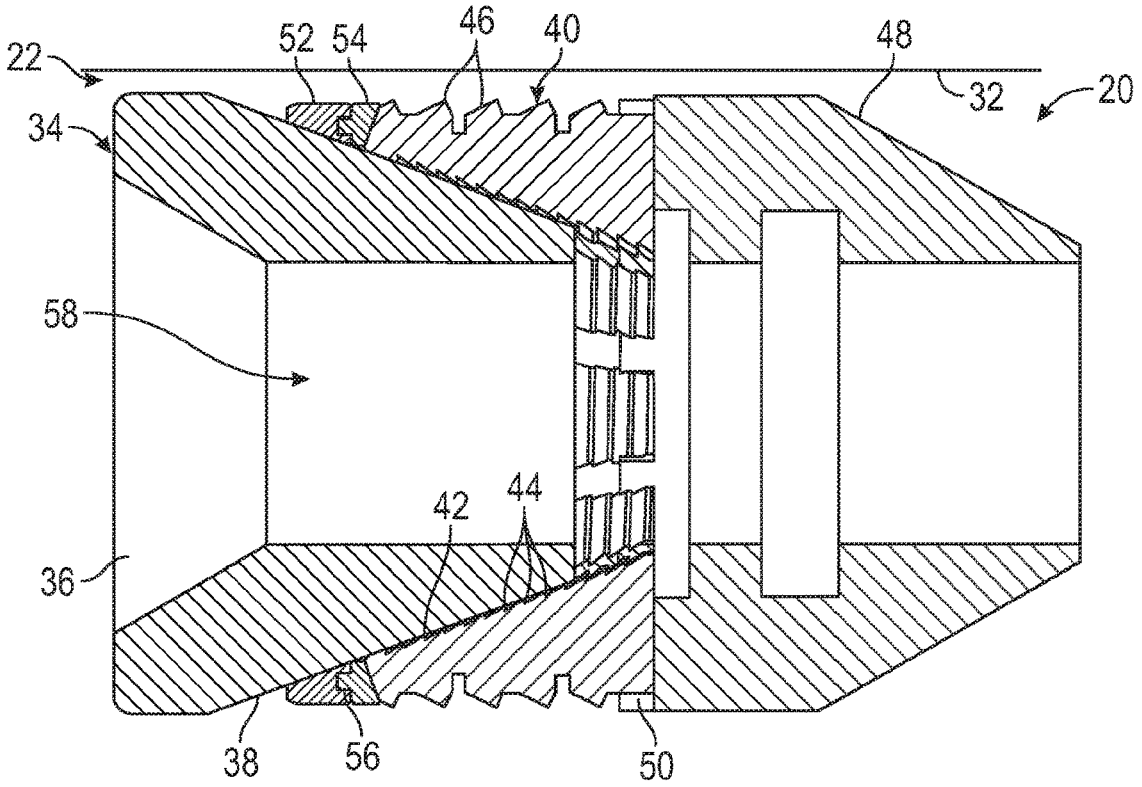
FIG. 2 is a cross-sectional view of an example of a frac diverter, according to an embodiment of the disclosure.

Referring generally to FIG. 2, an embodiment of the frac diverter 20 is illustrated in cross-section and in an unactuated, radially contracted position relative to a surrounding wellbore wall 32. The surrounding wellbore wall 32 may be an inner surface of casing 30. In the example illustrated, the frac diverter 20 comprises a cone 34 having a ball seat 36 and an external, sloped conical surface 38.

Figure 3:
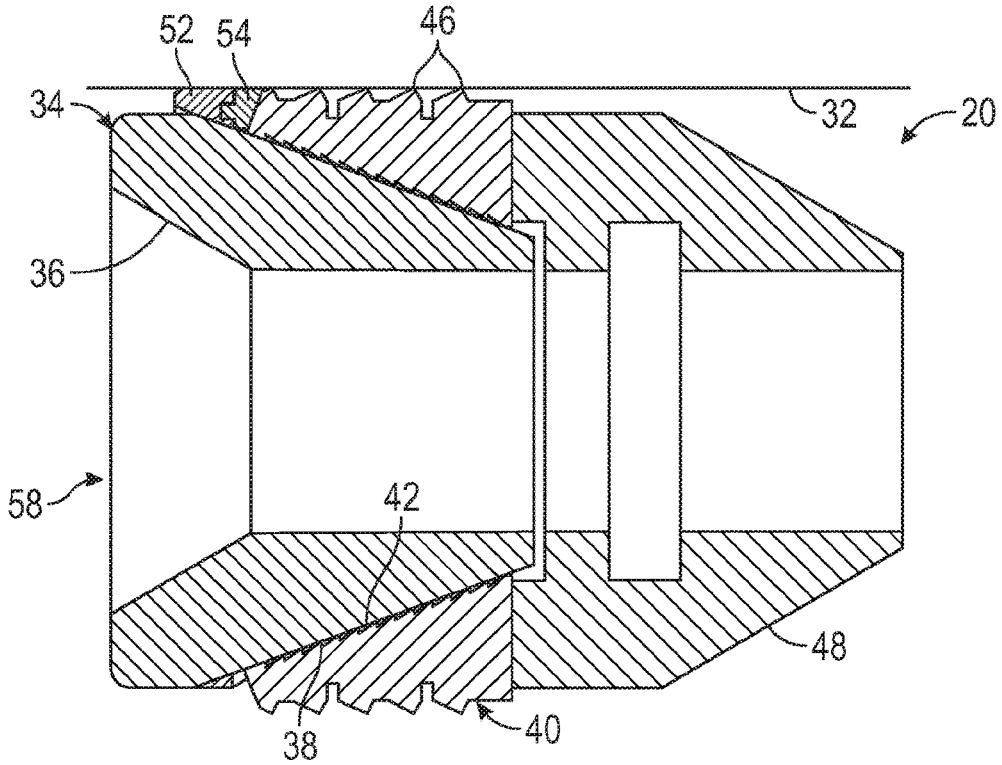
FIG. 3 is a cross-sectional view similar to that of FIG. 2 but showing the frac diverter in an actuated, radially expanded position, according to an embodiment of the disclosure.

The frac diverter 20 may further comprise a slip ring 40 mounted on the cone 34. For example, the slip ring 40 may be mounted along the external, conical surface 38 of cone 34. By way of further example, the slip ring 40 may have a plurality of slips 41 and an internal, sloped conical surface 42 sized and oriented to slide along the conical surface 38 of cone 34. In some embodiments, the internal conical surface 42 may comprise ridges 44 or other features to facilitate initial sliding along the corresponding conical surface 38 and subsequent locking into surface 38 to resist back pressure. Additionally, the slip ring 40 may comprise external gripping features 46, e.g. steel or ceramic teeth or buttons, oriented to engage and grip the surrounding wellbore wall surface 32 when actuated to a radially expanded position as illustrated in FIG. 3.

A bottom sub 48 may be positioned to engage slip ring 40 in a manner which effectively traps the slip ring 40 between cone 34 and bottom sub 48. In some embodiments, the bottom sub 48 may comprise engagement features 50 by which the bottom sub 48 engages a lower end of the slip ring 40. By way of example, the engagement features 50 may the in the form of castellations which engage corresponding features along the bottom of slip ring 40. The features/castellations 50 help ensure more uniform separation of slips 41 as the slip ring 40 is expanded during setting of the frac diverter 20.

In the embodiment illustrated, the frac diverter 20 further comprises at least one expandable ring, e.g. an upper expandable ring 52 and a lower expandable ring 54 which are both positioned around the cone 34. For example, the upper and lower expandable rings 52, 54 may be positioned around the conical surface 38 adjacent an upper end of slip ring 40. In some embodiments, the upper expandable ring 52 and lower expandable ring 54 may be engaged with each other via an interlocking mechanism 56, e.g. an interlocking ridge and groove. The upper and lower expandable rings 52, 54 may be in the form of C-rings, as illustrated, or other suitable expandable rings.

Figure 4:
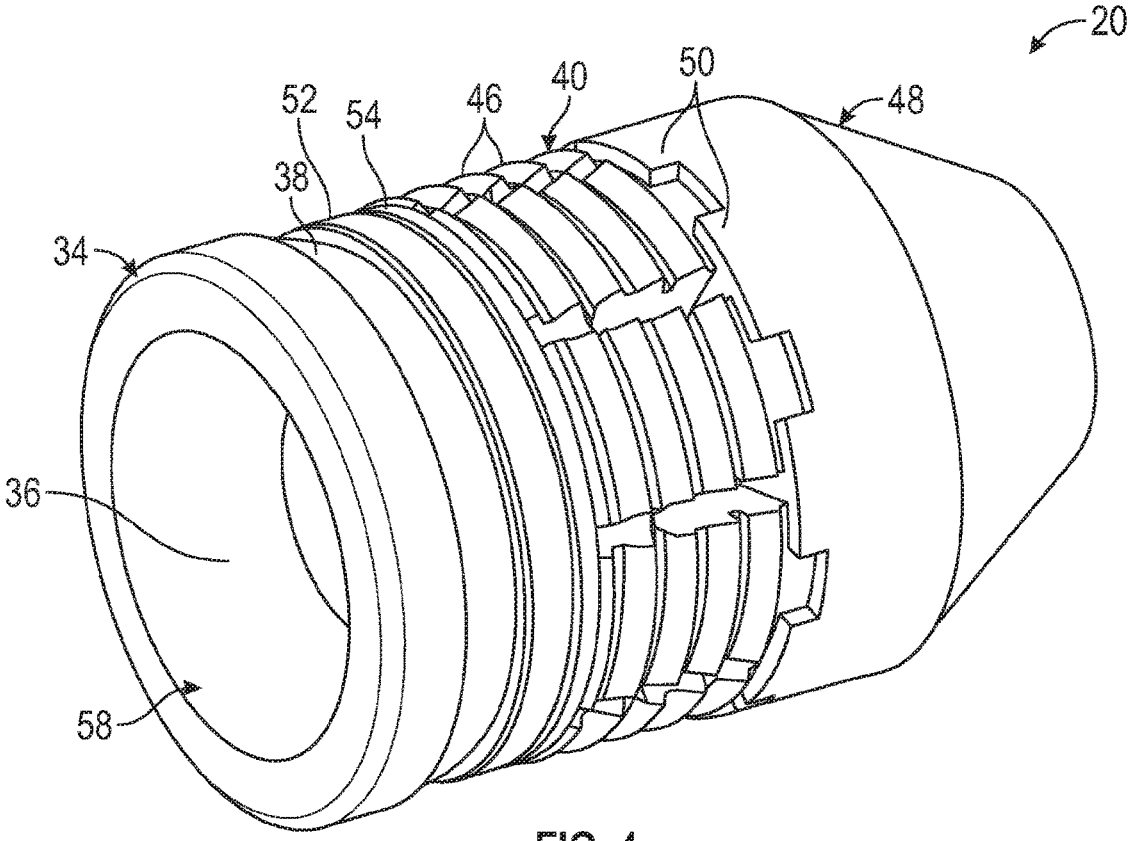
FIG. 4 is an orthogonal view of the frac diverter illustrated in FIG. 2, according to an embodiment of the disclosure.
Figure 5:
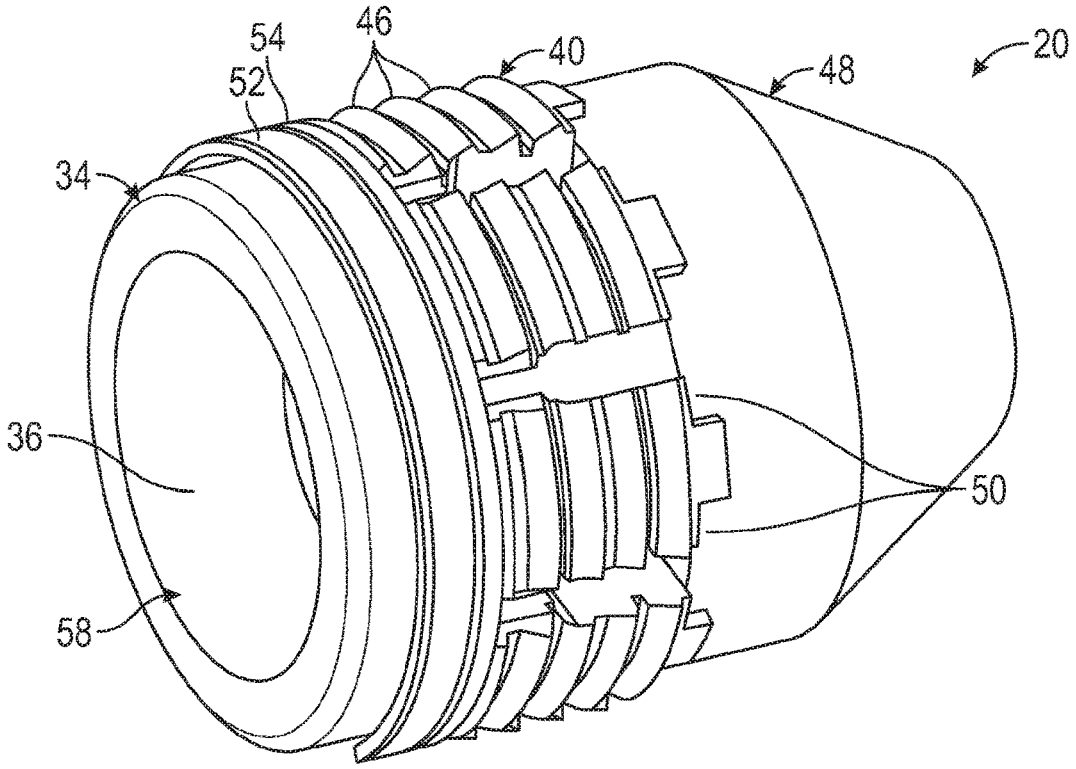
FIG. 5 is an orthogonal view of the actuated frac diverter illustrated in FIG. 3, according to an embodiment of the disclosure.

During actuation, the slip ring 40 along with the upper expandable ring 52 and lower expandable ring 54 are forced from a radially contracted position (see FIGS. 2 and 4) to a radially expanded position (see FIGS. 3 and 5) as the cone 34 is moved toward the bottom sub 48. The external, sloped conical surface 38 of cone 34 forces the upper expandable ring 52, lower expandable ring 54, and slip ring 40 radially outward as the cone 34 is moved axially toward bottom sub 48.

By way of example, the force to actuate the frac diverter 20 from the radially contracted position to the radially expanded position may be obtained by using a suitable tool or dropping a ball against ball seat 36 to block a frac diverter through passage 58. Once the ball is seated against ball seat 36, pressure may be applied along wellbore 22 to force cone 34 toward bottom sub 48. It should be noted the frac diverter 20 may initially be held by friction with the surrounding wellbore wall 32 or by engagement with features disposed along casing 30 until gripping members 46 are able to engage the surrounding wellbore wall 32. Continued application of pressure in borehole 22 causes full radial expansion of the frac diverter 20. It also should be noted a ball also may be used to block flow through passage 58 during a fracturing operation.

Once the upper expandable ring 52, lower expandable ring 54, and slip ring 40 are transitioned to the radially expanded position (see FIG. 3) with a ball plugging passage 58, flow of fracturing fluid 24 is substantially restricted. Effectively, the space between wellbore wall surface 32 and the expandable rings 52, 54/slip ring 40 is substantially reduced. During a fracturing operation, the flow volume of fracturing fluid 24 is much higher relative to leakage past frac diverter 20. As a result, the fracturing operation may be performed without detrimental impact even though a seal may not be formed between the frac diverter 20 and the surrounding wall surface 32.

Figure 6:
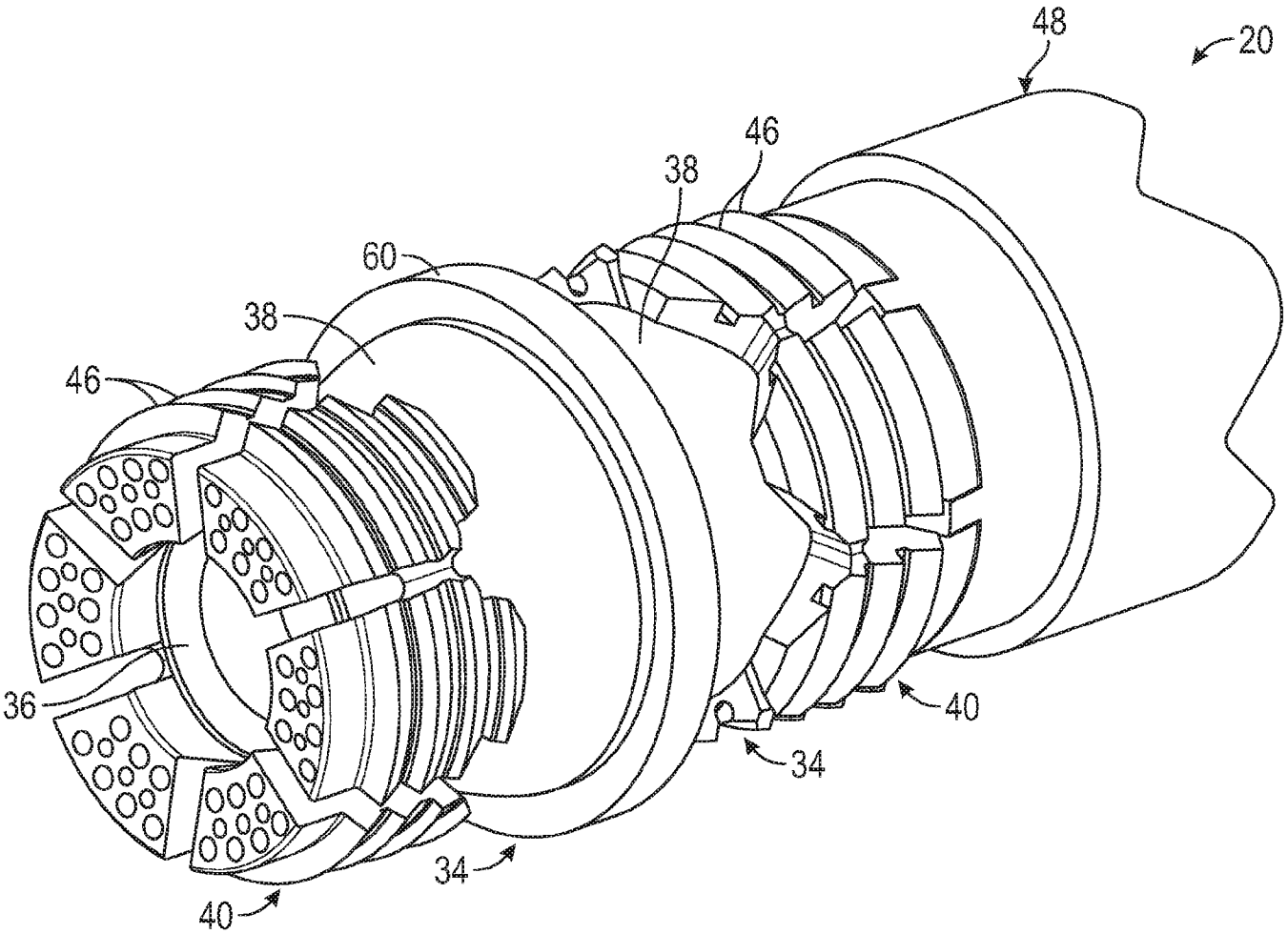
FIG. 6 is an orthogonal view of another example of a frac diverter, according to an embodiment of the disclosure.
Figure 7:
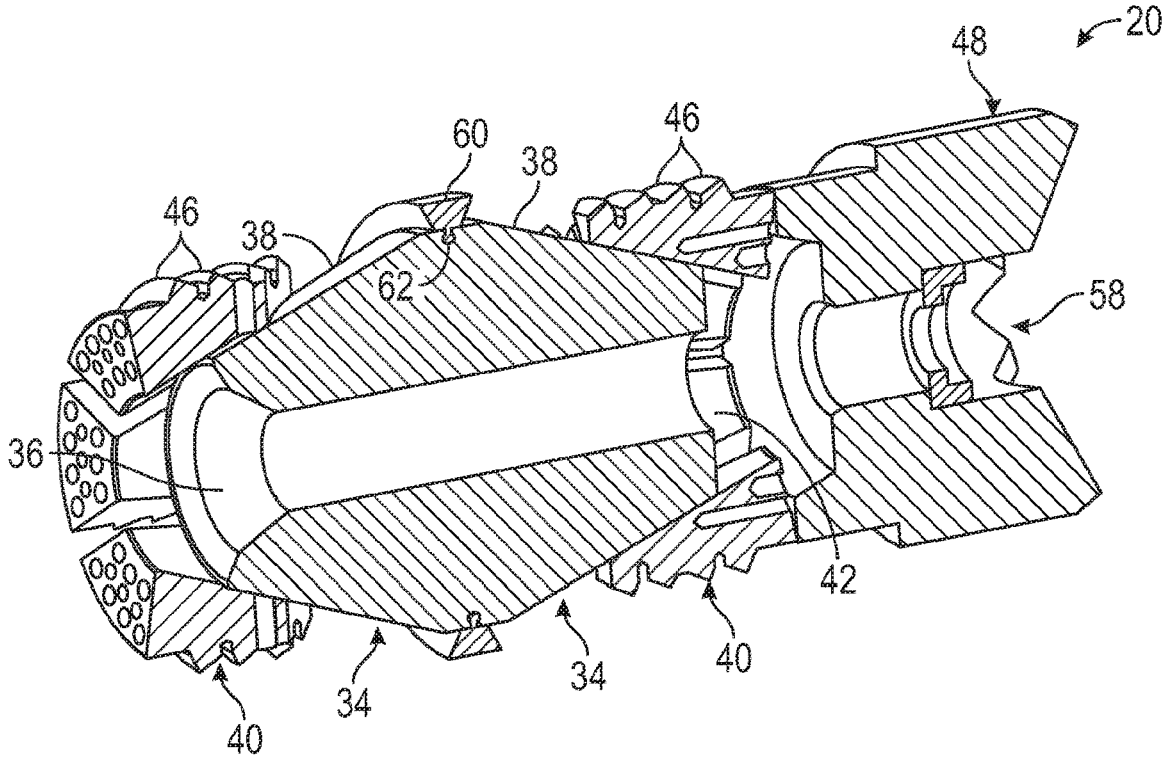
FIG. 7 is a cross-sectional view of the frac diverter illustrated in FIG. 6, according to an embodiment of the disclosure.
Figure 8:
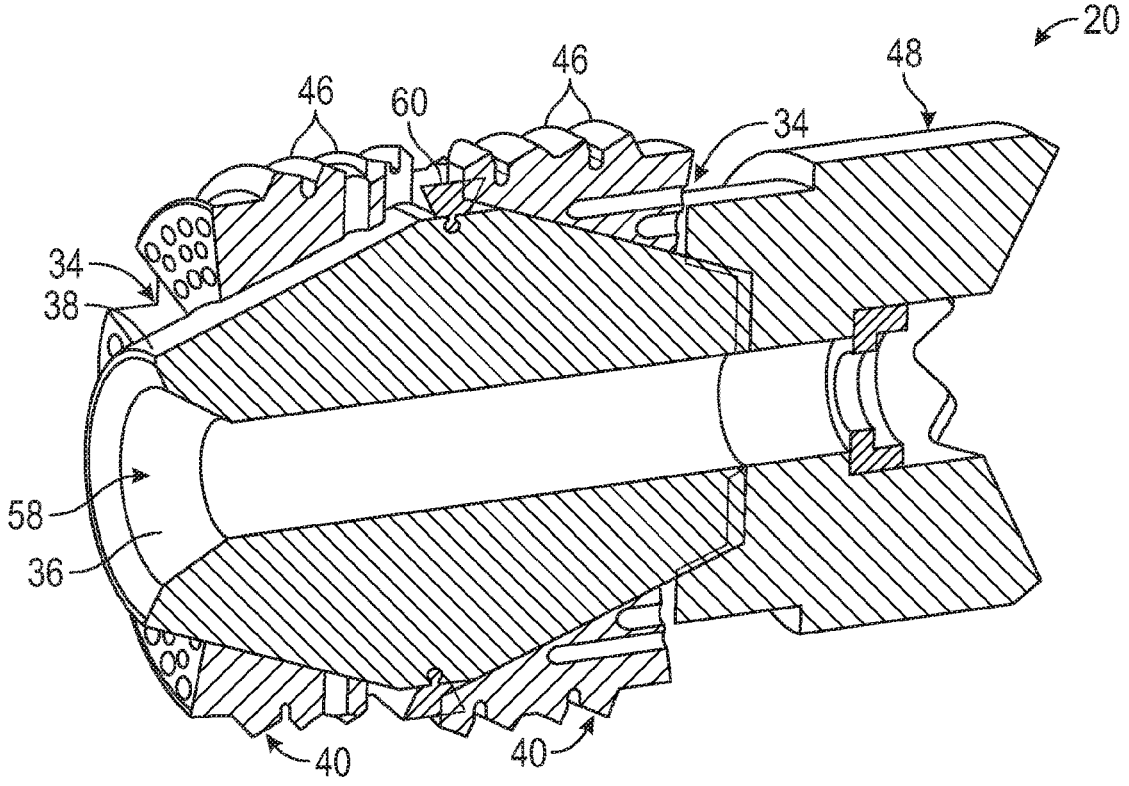
FIG. 8 is a cross-sectional view similar to that of FIG. 7 but showing the frac diverter in an actuated, radially expanded position, according to an embodiment of the disclosure.

Referring generally to FIGS. 6-8, another embodiment of frac diverter 20 is illustrated. In this example, the frac diverter 20 comprises a pair of cones 34 used with a pair of slip rings 40. By way of example, the pair of cones 34 may be positioned such that their external, conical surfaces 38 slope away from each other as they angle radially inward to provide bi-directional conical surfaces. In some embodiments, the pair of cones 34 may be joined as a single unit and serve as a bi-directional cone structure, as illustrated in the cross-sectional views of FIGS. 7 and 8.

In the illustrated example, the bottom sub 48 may be positioned adjacent the lower end of the lower slip ring 40. Additionally, the frac diverter 20 may comprise at least one flow restrictor ring 60 positioned between the slip rings 40. The flow restrictor ring 60 may be formed of an elastomeric material or other suitable material to provide a desired flow restriction with respect to flow past the frac diverter 20 when in the radially expanded position (see FIG. 8). Even though the flow restrictor ring 60 may form an incidental, temporary seal, or even longer term seal, the size, materials, and structure of the ring 60 are not selected to ensure maintenance of a permanent seal. Consequently, the use of less expensive materials and construction is enabled. In some embodiments, the flow restrictor ring 60 may be positioned in a corresponding groove 62 formed in the unitary construction of the pair of cones 34 as illustrated. Additionally, some embodiments may omit the flow restrictor ring 60 and utilize the flow restriction provided by the expanded slip rings 40. For example, the slip rings 40 may be constructed with triangular cuts which move into engagement with each other in the expanded position to restrict flow.

During actuation of the frac diverter 20, the slip rings 40 are forced from a radially contracted position to a radially expanded position as the slip rings 40 are moved toward each other along the sloped surfaces 38 of corresponding cones 34. The slip rings 40 may be moved into contact with the flow restrictor ring 60 when radially expanded. The actuation may be caused by using a tool or a ball and increased wellbore pressure as described above. As illustrated in FIG. 8, the flow restrictor ring 60 may be positioned between the slip rings 40 to substantially restrict flow of fracturing fluid past the frac diverter 20 when the slip rings 40 are in the radially expanded position. The resulting restriction of flow past the frac diverter 20 enables performance of a fracturing operation independently of whether the flow restrictor ring 60 seals against the wall 32 of the wellbore. It should be noted the flow restrictor ring 60 also may be constructed to restrict flow while the frac diverter 20 is in a radially contracted, run-in-hole position.

Figure 9:
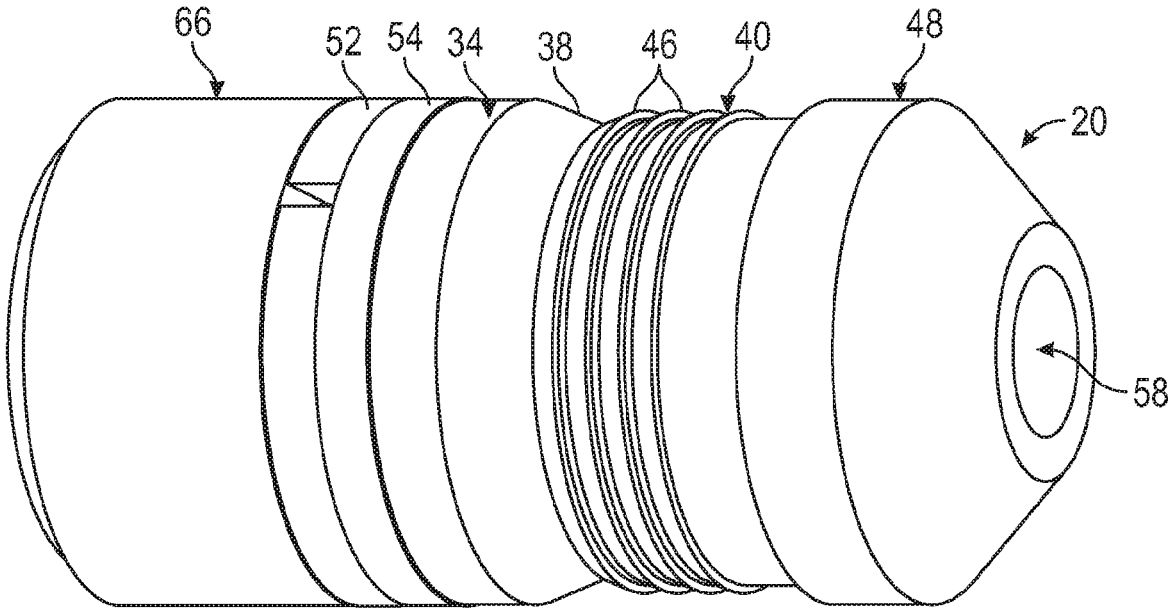
FIG. 9 is an orthogonal view of another example of a frac diverter, according to an embodiment of the disclosure.
Figure 10:
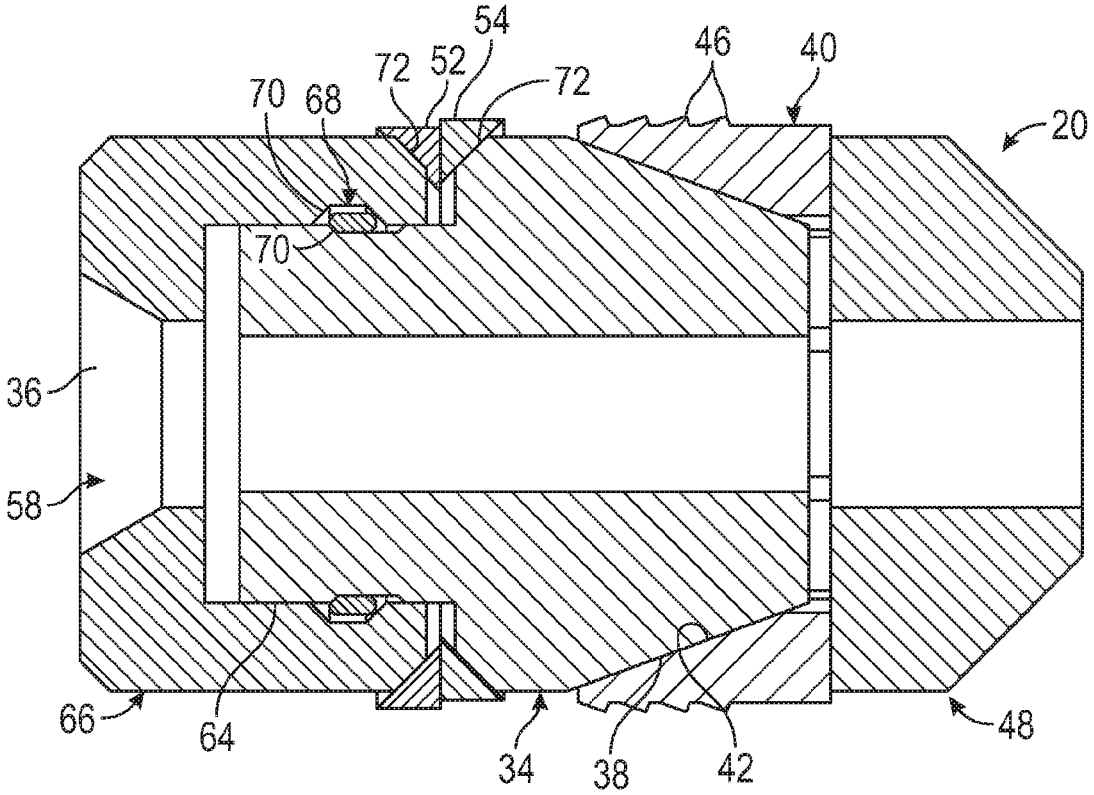
FIG. 10 is a cross-sectional view of the frac diverter illustrated in FIG. 9 but showing the frac diverter in an actuated, radially expanded position, according to an embodiment of the disclosure.

Referring generally to FIGS. 9 and 10, another embodiment of frac diverter 20 is illustrated. In this example, the frac diverter 20 again comprises cone 34 but the cone 34 has a cylindrical extension 64 which slidably receives a ball seat member 66. The ball seat member 66 is a separate component which includes ball seat 36 oriented to receive a ball so that pressure may be increased in borehole 22 to enable setting of the frac diverter 20. In some embodiments, a locking mechanism 68 such as a lock ring may be positioned between the cylindrical extension 64 and the interior of ball seat member 66.

While the frac diverter 20 is actuated to the radially expanded position, the ball seat member 66 slides in an axial direction along the cylindrical extension 64 until locked in the actuated state via locking mechanism 68. If the locking mechanism 68 is in the form of a lock ring, the lock ring may be trapped in corresponding grooves 70 formed in adjacent surfaces of the cylindrical extension 64 and ball seat member 66. It should be noted the cylindrical extension 64 may be coupled with ball seat member 66 such that the corresponding cone 34 slides along the cylindrical extension 66. In either configuration, the ball seat member 66 and corresponding cone 34 are slidable with respect to each other.

The frac diverter 20 may again comprise slip ring 40 mounted on cone 34 along the external, conical surface 38. The internal, sloped conical surface 42 of slip ring 40 is similarly sized and oriented to slide along the conical surface 38 of cone 34. Additionally, the slip ring 40 may comprise external gripping features 46, e.g. teeth, oriented to engage and grip the surrounding wellbore wall surface 32 when actuated to a radially expanded position as illustrated in FIG. 10. The bottom sub 48 may be positioned to engage slip ring 40 in a manner which effectively traps the slip ring 40 between cone 34 and bottom sub 48.

In the embodiment illustrated, the frac diverter 20 further comprises at least one expandable ring such as the illustrated upper expandable ring 52 and lower expandable ring 54, e.g. upper and lower expandable C-rings. In this embodiment, however, the upper and lower expandable rings 52, 54 are positioned between ball seat member 66 and cone 34. The upper and lower expandable rings 52, 54 may each be positioned against corresponding angled surfaces 72 on the ball seat member 66 and cone 34 such that movement of ball seat member 66 and cone 34 towards each other forces the upper and lower expandable rings 52, 54 in a radially outward direction as illustrated in FIG. 10.

Similar to other embodiments described herein, the force to actuate the frac diverter 20 from the radially contracted position to the radially expanded position may be obtained by using a suitable tool or by dropping a ball against ball seat 36. For example, once a ball is seated against ball seat 36, pressure may be applied along wellbore 22 to force ball seat member 66 toward cone 34 and to also force the sloped surface 38 of cone 34 into slip ring 40 and toward bottom sub 48. This relative axial movement, effectively forces the slip ring 40 and the upper and lower expandable rings 52, 54 in a radially outward direction to the radially extended position against wellbore wall 32 as illustrated in FIG. 10.

Once the upper expandable ring 52, lower expandable ring 54, and slip ring 40 are transitioned to the radially expanded position, flow of fracturing fluid 24 between the expandable rings 52, 54 and the surrounding wellbore wall surface 32 is substantially restricted. Even though a small amount of leakage may occur through, for example, gaps in the rings 52, 54, the leakage is minimal compared to the flow volume of fracturing fluid 24. As a result, the fracturing operation may be performed without detrimental impact even though a seal may not be formed between the frac diverter 20 and the surrounding wall surface 32.

Figure 11:
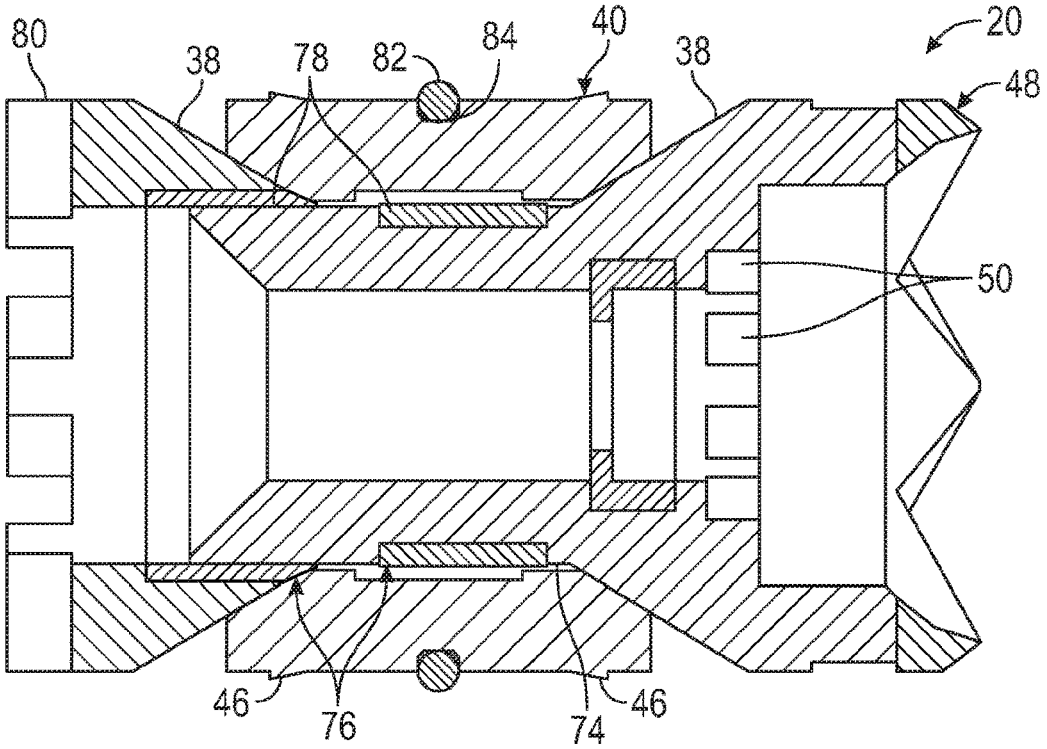
FIG. 11 is a cross-sectional view of another example of a frac diverter, according to an embodiment of the disclosure.
Figure 12:
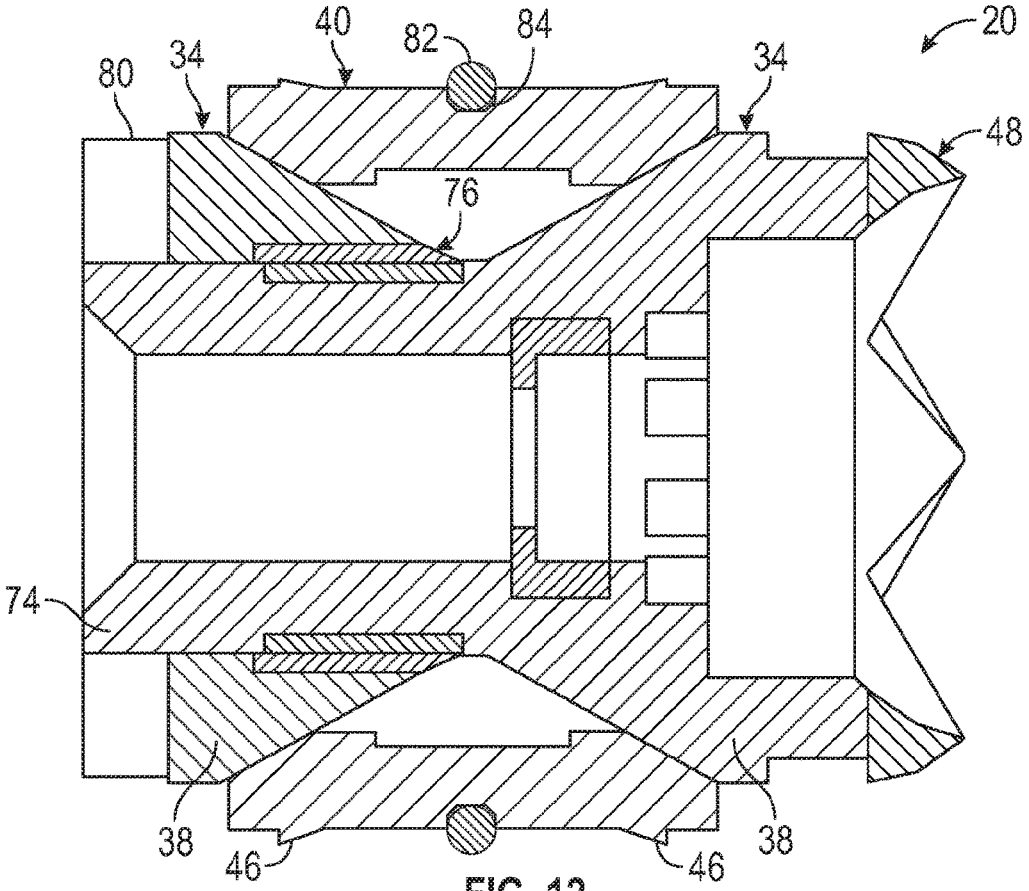
FIG. 12 is a cross-sectional view of the frac diverter illustrated in FIG. 11 but showing the frac diverter in an actuated, radially expanded position, according to an embodiment of the disclosure.

Referring generally to FIGS. 11 and 12, another embodiment of frac diverter 20 is illustrated. In this example, the frac diverter 20 comprises a pair of cones 34 oriented such that at least one slip ring 40, e.g. a bi-directional slip ring, is positioned therebetween. By way of example, the pair of cones 34 may be positioned such that their external, conical surfaces 38 slope toward each other as they angle radially inward. One of the cones 34 may be slidably mounted on a cylindrical extension 74 of the other of the cones 34. In some embodiments, a retention mechanism 76 may be used to hold the frac diverter 20 in the radially expanded position illustrated in FIG. 12. The retention mechanism 76 may have various features such as the illustrated ratchet ring which comprises two ratchet ring components 78 that slide into engagement with each other as the frac diverter 20 is actuated from the radially contracted position illustrated in FIG. 11 to the radially expanded position illustrated in FIG. 12.

In the illustrated example, the bottom sub 48 may be positioned adjacent the lower end of one of the cones 34 and an upper sub 80 may be positioned adjacent the upper end of the other cone 34. Additionally, the frac diverter 20 may comprise at least one flow restrictor ring 82 positioned about an exterior of the bi-directional slip ring 40 located between the cones 34. In the illustrated example, the flow restrictor ring 82 is positioned in a corresponding groove 84 formed circumferentially about the bi-directional slip ring 40.

The flow restrictor ring 82 may be formed of an elastomeric material or other suitable material to provide a desired flow restriction with respect to flow past the frac diverter 20 when in the radially expanded position (see FIG. 12). Even though the flow restrictor ring 82 may form an incidental or temporary seal, the size, materials, and structure of the flow restrictor ring 82 are not selected to maintain a permanent seal, thus enabling less expensive materials and construction.

During actuation of the frac diverter 20, the bi-directional slip ring 40 is forced from a radially contracted position to a radially expanded position as the surfaces 38 of cones 34 are moved toward each other and into the slip ring 40. The actuation may be caused by using a ball and increased wellbore pressure as described above or by engaging and axially shifting upper sub 80 via a suitable tool. As illustrated in FIG. 12, the flow restrictor ring 82 may be forced in a radially outward direction to substantially restrict flow of fracturing fluid past the frac diverter 20 when the slip ring 40 is in the radially expanded position. The resulting restriction of flow past the frac diverter 20 enables performance of a fracturing operation independently of whether the flow restrictor ring 82 seals against the wall 32 of the wellbore.

Figure 13:
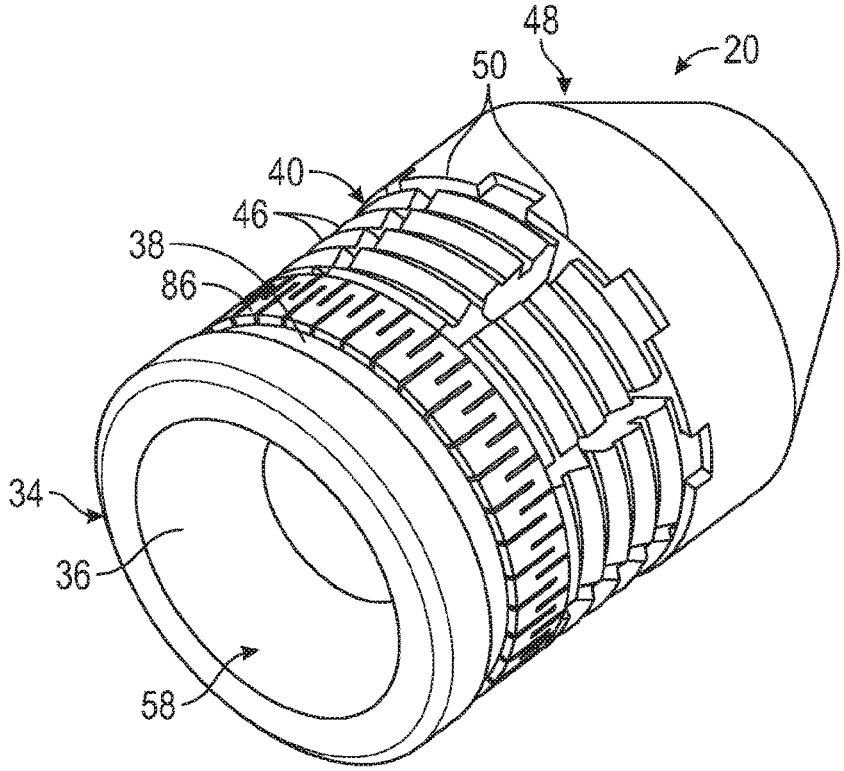
FIG. 13 is an orthogonal view of another example of a frac diverter, according to an embodiment of the disclosure.
Figure 14:
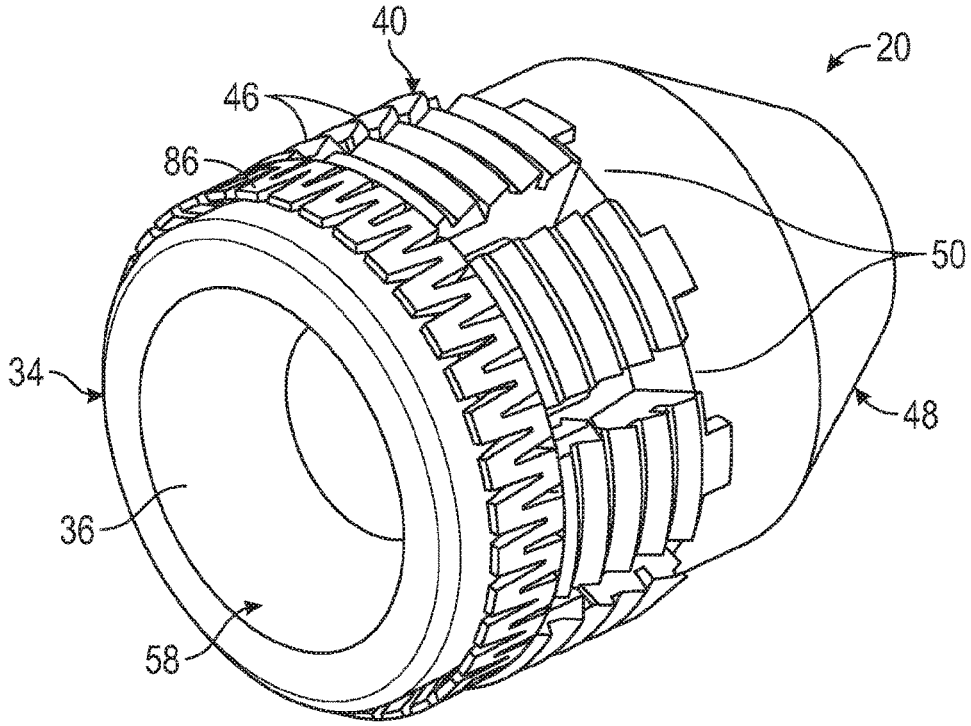
FIG. 14 is an orthogonal view of the frac diverter illustrated in FIG. 13 but showing the frac diverter in an actuated, radially expanded position, according to an embodiment of the disclosure.

Referring generally to FIGS. 13 and 14, another embodiment of the frac diverter 20 is illustrated in a radially contracted position and a radially expanded position, respectively. Similar to the embodiment illustrated in FIGS. 2-5, the frac diverter 20 may comprise cone 34 having ball seat 36 and external, sloped conical surface 38. The frac diverter 20 may further comprise slip ring 40 mounted on the cone 34. For example, the slip ring 40 may be mounted such that internal conical surface 42 is slidably positioned along the external, conical surface 38 of cone 34. Additionally, the slip ring 40 may comprise external gripping features 46, e.g. teeth, oriented to engage and grip the surrounding wellbore wall surface 32 when actuated to a radially expanded position as illustrated in FIG. 14. Bottom sub 48 may again be positioned to engage slip ring 40 and may comprise engagement features 50.

In the embodiment illustrated, the frac diverter 20 further comprises at least one expandable ring, e.g. the illustrated single expandable ring 86. By way of example, the expandable ring 86 may be an accordion style ring or other suitable ring which can readily expand from the contracted position illustrated in FIG. 13 to the expanded position illustrated in FIG. 14. The expandable ring 86 may be positioned around the conical surface 38 adjacent an upper end of slip ring 40.

During actuation, the slip ring 40 along with the expandable ring 86 are forced from the radially contracted position to the radially expanded position as the cone 34 is moved toward the bottom sub 48. The external, sloped conical surface 38 of cone 34 forces the expandable ring 86 and the slip ring 40 radially outward as the cone 34 is moved axially toward bottom sub 48.

As described above, the force to actuate the frac diverter 20 from the radially contracted position to the radially expanded position may be obtained by using a suitable tool or dropping a ball against ball seat 36 to block the frac diverter through passage 58. Once the expandable ring 86 and the slip ring 40 are transitioned to the radially expanded position (with a ball plugging passage 58), flow of fracturing fluid 24 is substantially restricted. Similar to other embodiments described herein, the fracturing operation may be performed without detrimental impact even though a continuous seal may not be formed between the expandable ring 86 and the surrounding wall surface 32.

Figure 15:
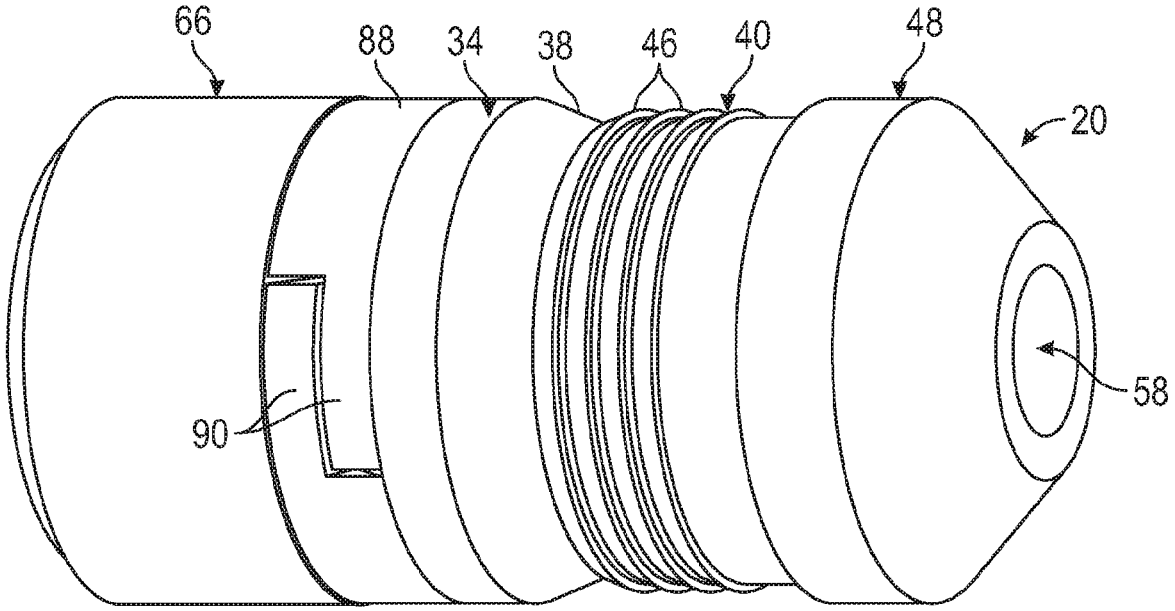
FIG. 15 is an orthogonal view of another example of a frac diverter, according to an embodiment of the disclosure.
Figure 16:
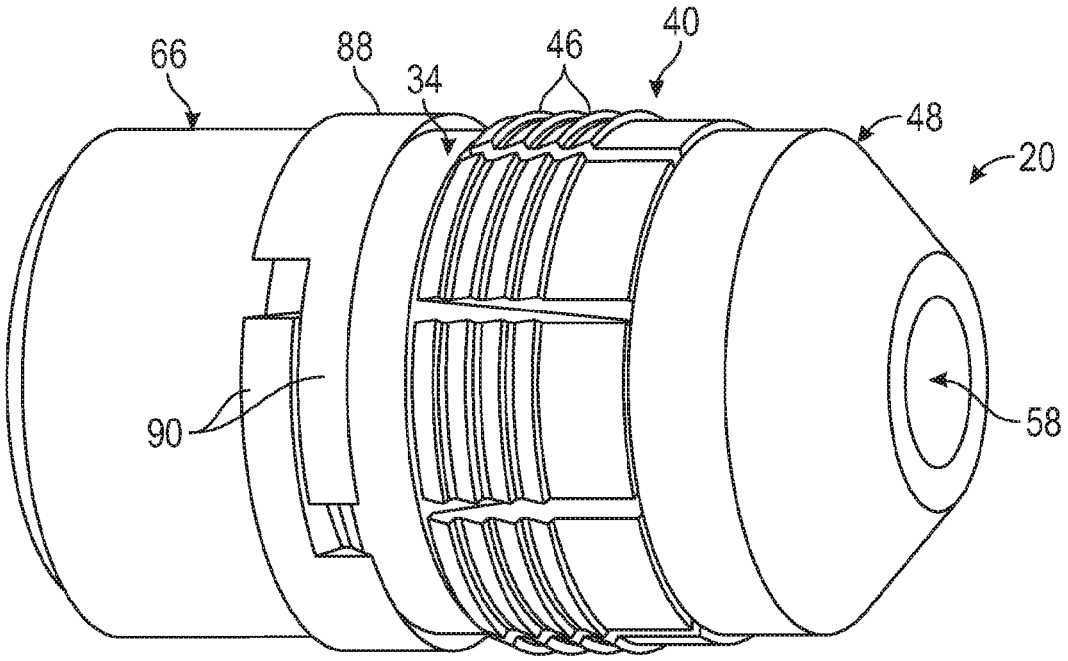
FIG. 16 is an orthogonal view of the frac diverter illustrated in FIG. 15 but showing the frac diverter in an actuated, radially expanded position, according to an embodiment of the disclosure.

Referring generally to FIGS. 15 and 16, another embodiment of frac diverter 20 is illustrated. Similar to the embodiment illustrated in FIGS. 9 and 10, the frac diverter 20 again comprises cone 34 slidably combined with ball seat member 66. The frac diverter 20 may again comprise slip ring 40 mounted on cone 34 along the external, conical surface 38. The internal, sloped conical surface 42 of slip ring 40 may be sized and oriented to slide along the conical surface 38 of cone 34. Additionally, the slip ring 40 may comprise external gripping features 46, e.g. teeth, oriented to engage and grip the surrounding wellbore wall surface 32 when actuated to a radially expanded position as illustrated in FIG. 16. The bottom sub 48 may be positioned to engage slip ring 40 in a manner which effectively traps the slip ring 40 between cone 34 and bottom sub 48.

In the embodiment illustrated, the frac diverter 20 further comprises at least one expandable ring, such as the illustrated single expandable ring 88. In this embodiment, the expandable ring 88 comprises overlapping ends 90 which slide relative to each other as the frac diverter 20 is transitioned from the radially contracted position (see FIG. 15) to the radially expanded position (see FIG. 16). The expandable ring 88 may be positioned between ball seat member 66 and cone 34 such that movement of ball seat member 66 and cone 34 towards each other forces the expandable ring 88 in a radially outward direction.

Similar to other embodiments described herein, once the expandable ring 88 and the slip ring 40 are transitioned to the radially expanded position, flow of fracturing fluid 24 between the expandable ring 88 and the surrounding wellbore wall surface 32 is substantially restricted. Even though a small amount of leakage may occur, the leakage is minimal compared to the flow volume of fracturing fluid 24. As a result, the fracturing operation may be performed without detrimental impact even though a seal may not be formed between the frac diverter 20 and the surrounding wall surface 32.

Figure 17A:
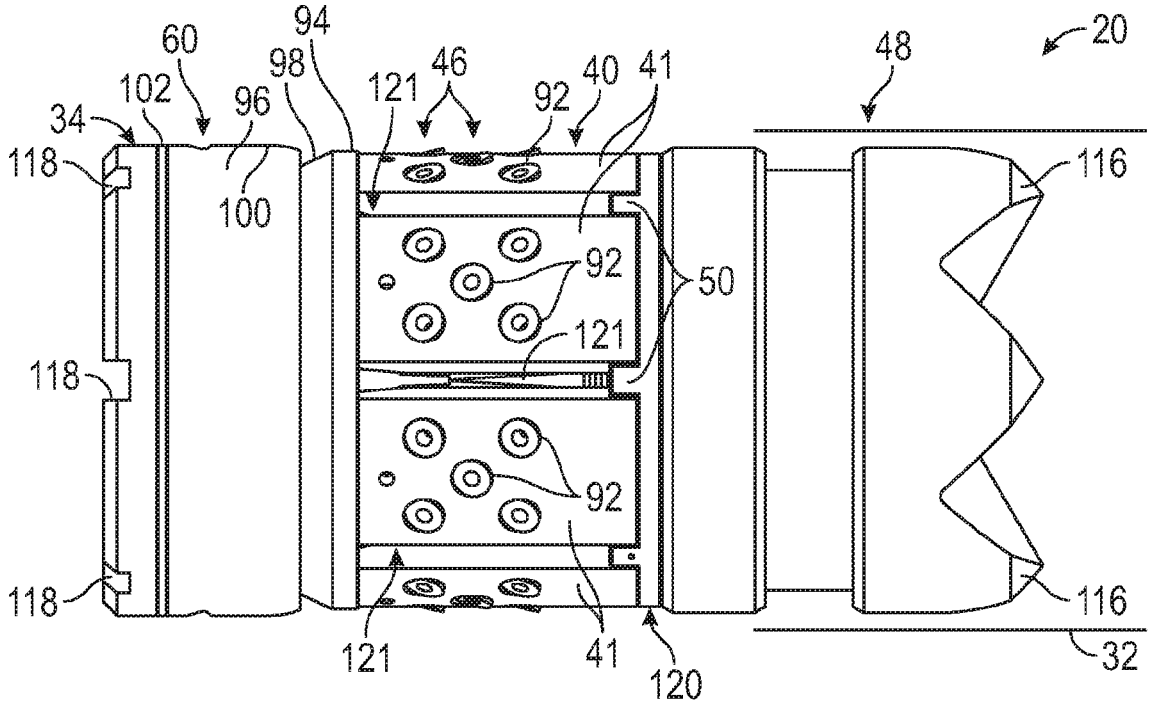
FIG. 17A is a side view of another example of a frac diverter, according to an embodiment of the disclosure.
Figure 17B:
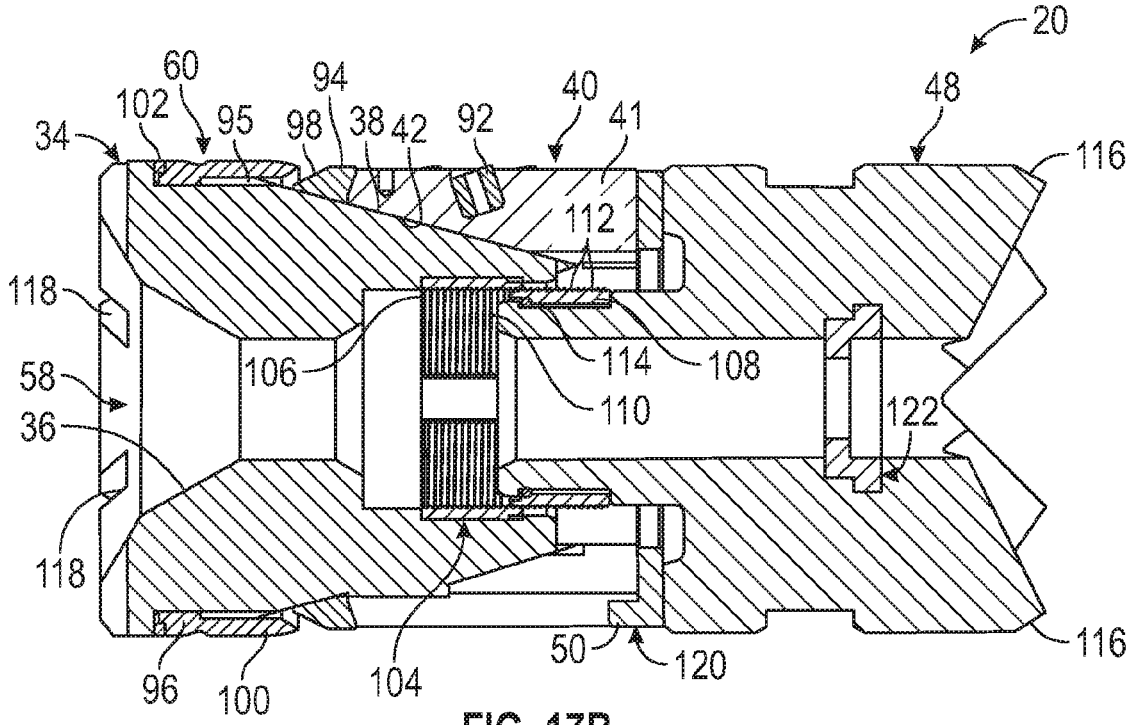
FIG. 17B is a cross-sectional view of the frac diverter illustrated in FIG. 17A, according to an embodiment of the disclosure.

Referring generally to FIGS. 17A and 17B, another embodiment of frac diverter 20 is illustrated. In this example, the frac diverter 20 again comprises cone 34 having conical surface 38 which slidingly cooperates with conical surface 42 of slip ring 40. In some embodiments, the conical surface 38 may comprise a series of flat surface areas disposed circumferentially around the cone 34. In such an embodiment, the individual slips 41 of slip ring 40 may be positioned against corresponding flat surface areas of conical surface 38.

The slip ring 40 may comprise gripping elements 46 in the form of, for example, buttons 92 formed of steel, ceramic, or other suitable material able to bite into the surrounding wellbore wall 32, e.g. casing wall, when the frac diverter 20 is actuated to a radially expanded position. The buttons 92 may be generally cylindrical in shape and oriented at a suitable angle with respect to the corresponding slips 41 to facilitate the biting engagement.

As with other embodiments, the slip ring 40 may be secured between cone 34 and bottom sub 48. When the cone 34 and bottom sub 48 are moved toward each other, the slips 41 of slip ring 40 are forced radially outward to engage gripping elements 46 with the surrounding wellbore wall 32, e.g. casing wall. In addition to being forced radially outward via conical surface 38, the slip ring 40 also moves a backup ring 94, e.g. a tapered cone backup ring, into engagement with flow restrictor ring 60 and a bottom backup ring 95 which may have a sloped lead edge. In this example, the flow restrictor ring 60 may be in the form of an elastomeric sealing element 96. The force to actuate the frac diverter 20 from the radially contracted position to the radially expanded position may be provided via a suitable tool or by dropping a ball against ball seat 36 to block the frac diverter through-passage 58 against applied pressure as described above with other embodiments.

In this example, the backup ring 94 has a sloped engagement surface 98 oriented to engage the sealing element 96. The backup rings 94, 95 may be formed of a suitable material or materials, such as high elongation polyetheretherketone (PEEK) or RYTON® PPS (polyphenylene sulfide). The sealing element 96 also may be formed of a suitable elastomeric material, such as nitrile rubber (NBR), PEEK, polytetrafluoroethylene (PTFE), hydrogenated nitrile butadiene rubber (HNBR), RYTON® PPS, or Teflon®.

By way of example, the sealing element 96 may be a flapper style seal having a flexible/bendable lip 100 which can be flexed outwardly when engaged by backup ring 94. By way of further example, the sealing element 96 also may be constructed with lip 100 in the form of a cup style seal. In the illustrated embodiment, a second backup ring 102, e.g. a top backup ring, is trapped between the sealing element 96 and a portion of cone 34 such that the sealing element 96 is squeezed outwardly between backup ring 94 and second backup ring 102 as the backup ring 94 is forced farther into engagement with the sealing element 96 via slip ring 40. The second backup ring 102 may be formed of a variety of suitable materials, such as PEEK or RYTON® PPS.

Depending on the environment and usage of frac diverter 20, the frac diverter 20 may have a variety of additional or other features. For example, the frac diverter 20 may comprise a locking mechanism 104 which locks the slip ring 40 in a radially expanded position upon actuation of the frac diverter 20. By way of example, the locking mechanism 104 may be in the form of a locking ring mechanism having a first ring 106 coupled to an interior of the cone 34 and a second ring 108 secured to the bottom sub 48 at a position for engagement with the first ring 106.

In the illustrated embodiment, the first ring 106 comprises a plurality of internal ratchet grooves or notches 110 which allow the ratcheting engagement of corresponding external ratchet grooves or notches 112 of second ring 108. As the second ring 108 moves into the first ring 106 during setting of the frac diverter 20, sufficient flexibility of at least one of the rings 106, 108 enables the ratchet grooves 110, 112 to progressively interlock during movement of cone 34 toward bottom sub 48. Thus, the locking mechanism 104 is able to hold the slip ring 40 in its radially expanded, actuated position. An energizer ring 114 may be positioned to energize a stable lock between the first ring 106 and a second ring 108 by providing resilient tension on, for example, second ring 108 to ensure the ratchet grooves 112 of second ring 108 stay in tight engagement with the corresponding ratchet grooves 110 of first ring 106.

In some embodiments, the frac diverter 20 may utilize bottom sub 48 with chamfers 116 which facilitate deployment down through the wellbore 22, e.g. through packers and other equipment that may be in the wellbore. The cone 34 also may comprise a plurality of slots 118, e.g. radially oriented slots, at its top end. The slots 118 are arranged to provide easier engagement of the frac diverter 20 during millout following the fracturing operation.

In some embodiments, the castellations 50 may be positioned on a castellation ring 120 located between the slip ring 40 and the bottom sub 48. The castellation ring 120 and its castellations 50 help ensure a more uniform separation of the slips 41 as the slip ring 40 is expanded along conical surface 38 during setting of the frac diverter 20. For example, the slips 41 may be coupled to each other via material portions 121 which fracture apart as the slip ring 40 is expanded. The castellations 50 help ensure separation between the slips 41 after being fractured apart. In some applications, different materials or material structures may be used to create weakened areas between slips 41 to facilitate breakout of the slips 41. Such materials/material structures can be used with or instead of the castellations 50. Depending on the application, a shear device 122, e.g. a shear ring, may be positioned along interior passage 58 to facilitate setting of the frac diverter 20.

Figure 18A:
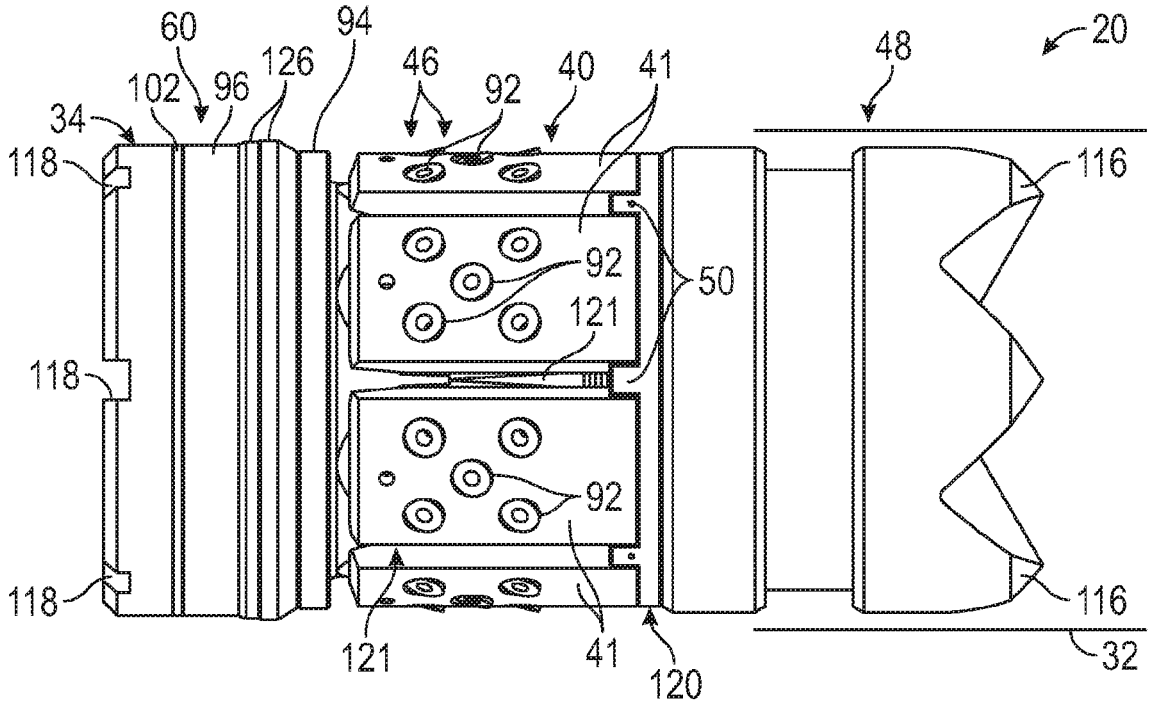
FIG. 18A is a side view of another example of a frac diverter, according to an embodiment of the disclosure.
Figure 18B:
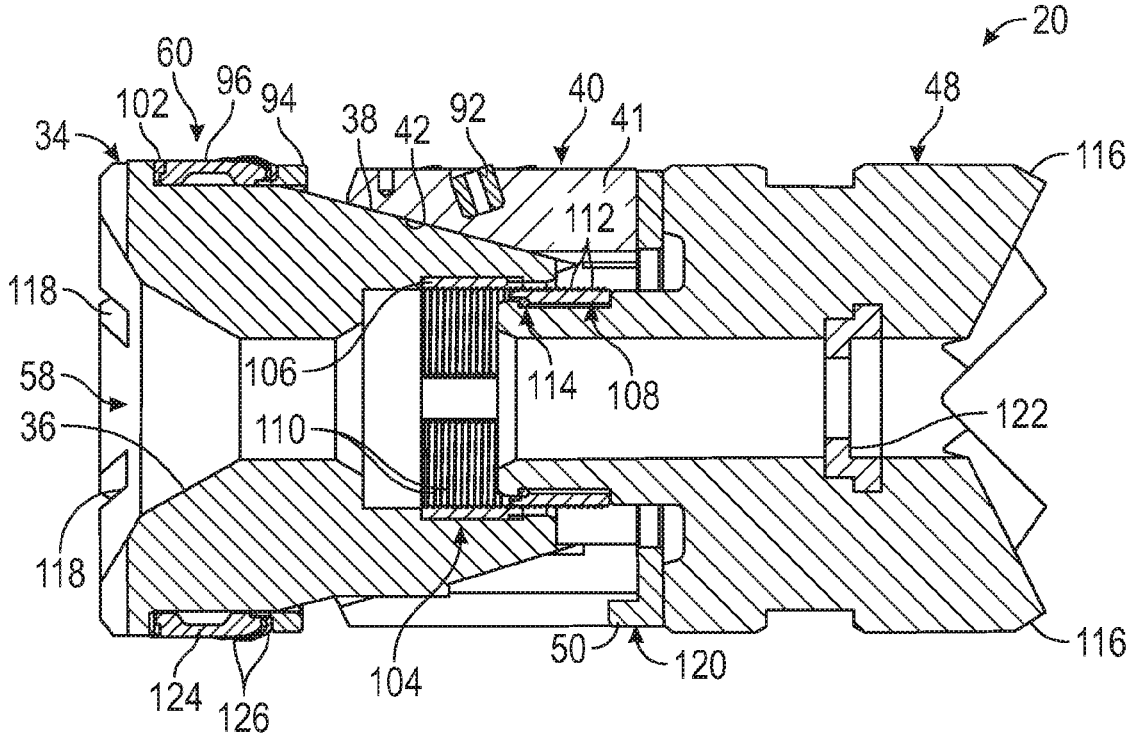
FIG. 18B is a cross-sectional view of the frac diverter illustrated in FIG. 18A, according to an embodiment of the disclosure.

Referring generally to FIGS. 18A and 18B, another embodiment of frac diverter 20 is illustrated. This embodiment is similar to the embodiment illustrated in FIGS. 17A and 17B in which the frac diverter 20 comprises cone 34 having conical surface 38 which slidingly cooperates with conical surface 42 of slip ring 40. The slip ring 40 may again comprise gripping elements 46 in the form of, for example, buttons 92 formed of steel, ceramic, or other suitable material. The buttons 92 are able to bite into the surrounding casing wall 32 when the frac diverter 20 is actuated to a radially expanded position.

As with other embodiments, the slip ring 40 may be secured between cone 34 and bottom sub 48. When the cone 34 and bottom sub 48 are moved toward each other, the slips 41 of slip ring 40 are forced radially outward to force engagement of gripping elements 46 with the surrounding wellbore wall. The moving slips 41 also serve to move backup ring 94 into engagement with flow restrictor ring 60. In this embodiment, the flow restrictor ring 60 is again in the form of an elastomeric sealing element 96 trapped between backup ring 94 and second backup ring 102.

However, the sealing element 96 has a thin center region 124 constructed to flex outwardly into engagement with the surrounding wellbore wall 32 as the sealing element 96 is squeezed between the backup rings 94, 102. In the illustrated example, at least one foldable anti-extrusion ring 126, e.g. two anti-extrusion rings 126, may be positioned between the sealing element 96 and the backup ring 94. The illustrated two anti-extrusion rings 126 are relatively thin and able to fold back when the frac diverter 20 is set by forcing slip ring 40 and sealing element 96 into engagement with the surrounding wellbore wall 32. In this actuated position, the anti-extrusion rings 126 are able to facilitate maintenance of at least a temporary seal by limiting extrusion of the elastomeric sealing element 96. By way of example, the at least one foldable anti-extrusion ring 126 may be formed of PEEK or other suitable material.

Figure 19A:
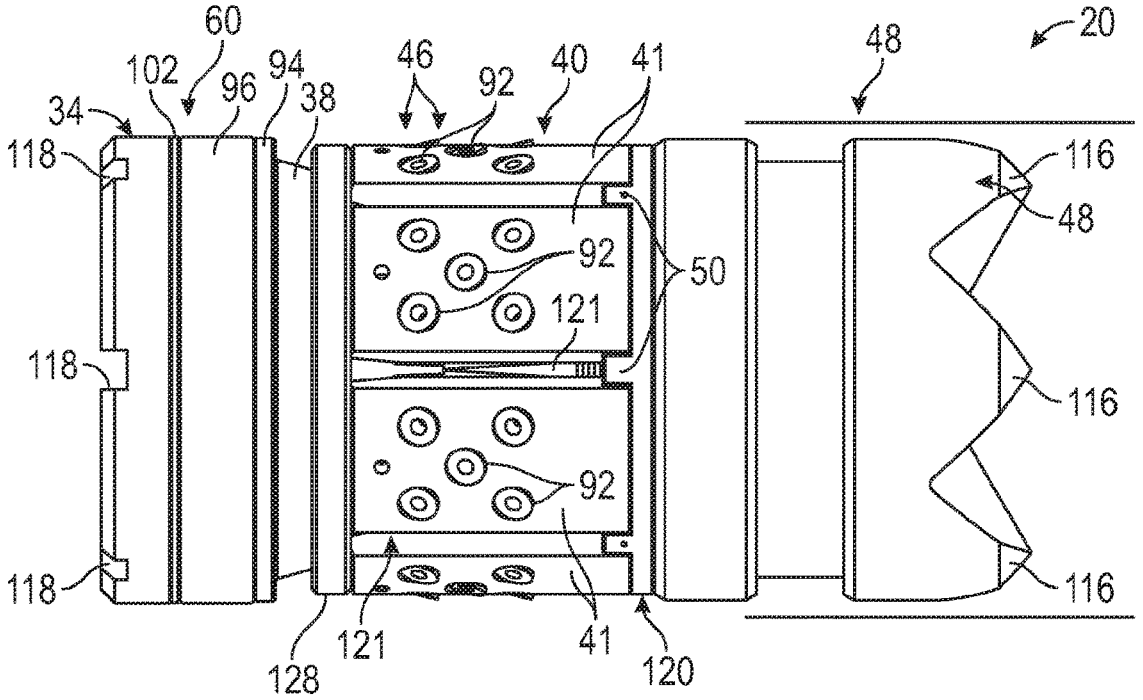
FIG. 19A is a side view of another example of a frac diverter, according to an embodiment of the disclosure.
Figure 19B:
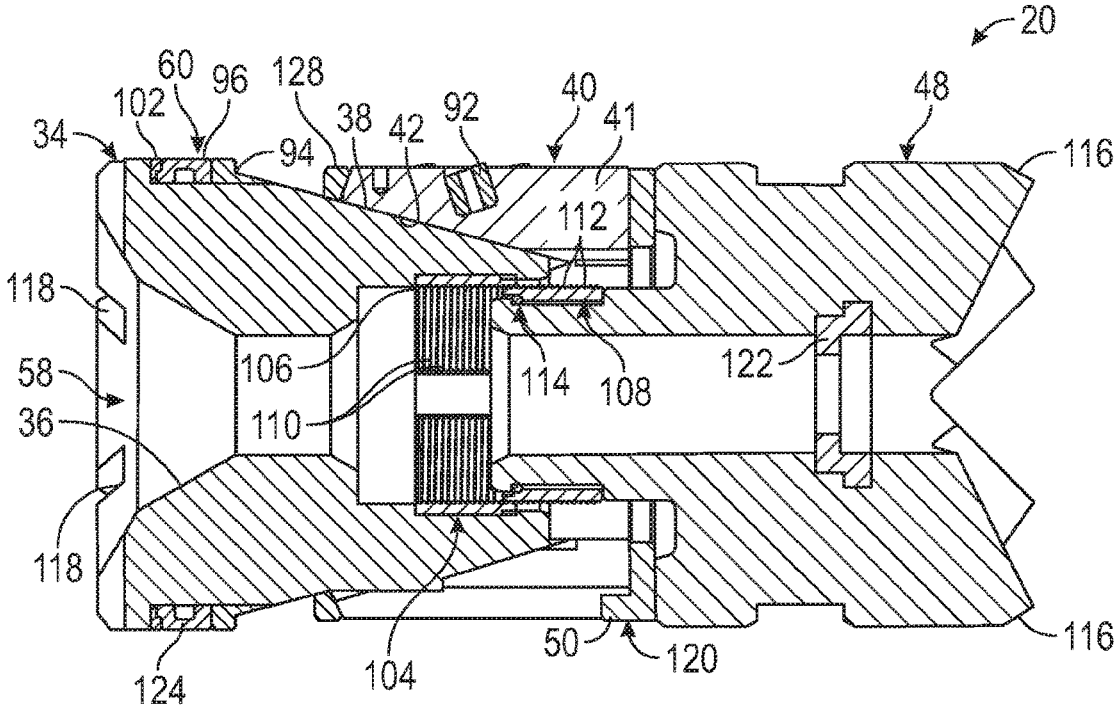
FIG. 19B is a cross-sectional view of the frac diverter illustrated in FIG. 19A, according to an embodiment of the disclosure.

Referring generally to FIGS. 19A and 19B, another embodiment of frac diverter 20 is illustrated. This embodiment is similar to the embodiment illustrated in FIGS. 18A and 18B in which the frac diverter 20 comprises cone 34 having conical surface 38 which slidingly cooperates with conical surface 42 of slip ring 40. The slip ring 40 may again comprise gripping elements 46 in the form of, for example, buttons 92 formed of steel, ceramic, or other suitable material able to bite into the surrounding casing wall 32 when the frac diverter 20 is actuated to a radially expanded position.

The slip ring 40 may be secured between cone 34 and bottom sub 48. When the cone 34 and bottom sub 48 are moved toward each other, the slips 41 of slip ring 40 are moved radially outward to force engagement of gripping elements 46 with the surrounding wellbore wall 32 as described above with respect to the embodiments illustrated in FIGS. 17 and 18. This action also moves backup ring 94 into engagement with flow restrictor ring 60.

In this latter embodiment, the flow restrictor ring 60 is again in the form of an elastomeric sealing element 96. However, the sealing element 96 is simply trapped between backup ring 94 and second backup ring 102. Depending on the application, the sealing element 96 may comprise the thin center region 124 which flexes outwardly into engagement with the surrounding wellbore wall as the sealing element 96 is squeezed between the backup rings 94, 102. The squeezing of sealing element 96 may be caused via a squeezing ring 128 which is forced against ring 94 via the longitudinal movement of slips 41 during actuation of frac diverter 20. By way of example, the squeezing ring 128 may be slidably mounted on conical surface 38 and may be formed of PEEK or other suitable material.

With the embodiments illustrated in FIGS. 17-19, actuation of the frac diverter 20 to the radially expanded position may once again be instigated by deploying a ball into engagement with ball seat 36 and applying sufficient pressure to effectively move cone 34 and bottom sub 48 toward one another. This motion moves slips 41 of slip ring 40 and sealing element 96 in cooperating, radially outward directions to effectively form a gripping and sealing engagement with the surrounding wellbore wall 32. As with other embodiments, however, incomplete sealing along sealing element 96 may still provide sufficient restriction to enable the desired fracturing operation. In some applications, other types of tools may be used to set the frac diverter 20.

Depending on the parameters of a given fracturing operation, the size, configuration, and materials of frac diverter 20 may vary. For example, the expandable rings 52, 54 may be constructed from metal materials, elastomeric materials, composite materials, or other suitable materials and may extend various distances about the circumference of frac diverter 20. For example, the expandable rings may be formed as C-rings with gaps between the ring ends or overlapping ends. However, the expandable rings may be constructed in various other forms to help reduce leakage flow.

Similarly, the flow restrictor rings 60, 82 may be formed from a variety of materials and may extend partially or fully about the circumference of the frac diverter 20 so as to reduce leakage during a fracturing operation. The cones and subs may be formed from suitable metals, e.g. cast-iron, composite materials, or other materials which are relatively inexpensive and easy to mill. Some embodiments described above, e.g. embodiments illustrated in FIGS. 17-19, may be made entirely from non-metallic components and materials. Other embodiments may be made substantially from non-metallic components and materials with certain components, e.g. buttons 92, formed from steel or other metal materials.

Additionally, components, component materials, and component configurations may be changed according to environmental or operational conditions. Depending on the application, various components of the illustrated embodiments may be interchanged with components of other embodiments. During a fracturing operation, the through passage 58 may be plugged with a ball or other suitable device to limit flow through the passage 58.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a frac diverter to enable a fracturing operation following expansion of the frac diverter against a surrounding wellbore wall, the frac diverter comprising:

a cone;

a slip ring mounted on the cone;

a bottom sub engaging the slip ring; a sealing element mounted about the cone;

a backup ring between the sealing element and the slip ring, the slip ring being forced from a radially contracted position to a radially expanded position as the cone is moved toward the bottom sub, the sealing element being simultaneously engaged by the backup ring and expanded radially outwardly to substantially restrict flow along the surrounding wellbore wall; and a lock ring mechanism which locks the slip ring in the radially expanded position.

2. The system as recited in claim 1, wherein the sealing element comprises a flapper or cup style seal having a lip expandable against the surrounding wellbore wall.

3. The system as recited in claim 1, wherein the sealing element comprises an expandable elastomeric ring adjacent an anti-extrusion ring.

4. The system as recited in claim 3, wherein the anti-extrusion ring is located between the expandable elastomeric ring and the backup ring.

5. The system as recited in claim 3, wherein the anti-extrusion ring is formed of PEEK.

6. The system as recited in claim 1, wherein the sealing element comprises an expandable elastomeric ring squeezed between the backup ring and a second backup ring.

7. The system as recited in claim 1, wherein the bottom sub comprises a castellation ring oriented to engage the slip ring.

8. The system as recited in claim 1, wherein the slip ring comprises a plurality of gripping members.

9. The system as recited in claim 8, wherein the plurality of gripping members comprises steel buttons.

10. The system as recited in claim 8, wherein the plurality of gripping members comprises ceramic buttons.

11. The system as recited in claim 1 wherein the cone comprises radially oriented slots to facilitate millout.

12. The system as recited in claim 1, wherein the lock ring mechanism comprises a first ring coupled to the cone and a second ring coupled to the bottom sub, the first ring and the second ring having ratchet grooves which progressively interlock as the second ring moves farther into engagement with the first ring.

13. The system as recited in claim 12, wherein the lock ring mechanism further comprises an energizer ring positioned to energize a stable lock between the first ring and the second ring.

14. A system, comprising: a frac diverter having:

a cone;

a plurality of slips mounted about the cone, the plurality of slips including gripping elements;

a bottom sub engaging the a plurality of slips;

a flow restrictor element mounted about the cone, the flow restrictor being expandable radially outwardly to substantially restrict flow along the surrounding wellbore wall, the flow restrictor being expandable via movement of the cone and the bottom sub toward each other, the cone having a conical surface oriented to force the plurality of slips in a radially outward direction until the gripping elements engage a surrounding wall surface;

a locking mechanism which locks the plurality of slips in a radially expanded position to maintain the gripping elements into engagement with the surrounding wall surface; and castellations positioned to maintain separation between slips of the plurality of slips.

15. The system as recited in claim 14, wherein the flow restrictor element comprises a flapper style seal with a lip expandable against the surrounding wall surface.

16. The system as recited in claim 14, wherein the flow restrictor element comprises an expandable elastomeric ring adjacent an anti-extrusion ring.

17. The system as recited in claim 16, wherein the anti-extrusion ring is located between the expandable elastomeric ring and the plurality of slips.

18. The system as recited in claim 16, wherein the anti-extrusion ring is formed of PEEK.

19. The system as recited in claim 14, wherein the flow restrictor element comprises an expandable elastomeric ring squeezed between a pair of backup rings.

20. The system as recited in claim 14, wherein the cone comprises radially oriented slots to facilitate millout.

21. A method, comprising:

positioning a cone in slidable engagement with a bottom sub;

mounting a slip ring between the cone and the bottom sub such that an internal conical surface of the slip ring engages an external conical surface of the cone;

locating an elastomeric sealing element between a portion of the cone and the slip ring such that movement of the cone and the bottom sub toward each other causes radial expansion of the slip ring and expansion of the elastomeric sealing element as the elastomeric sealing element is squeezed between a portion of the cone and the slip ring; and locking the cone and the bottom sub together in a position maintaining the slip ring and the elastomeric sealing element in a radially expanded position.

22. The method as recited in claim 21, wherein locating an elastomeric sealing element comprises locating a flapper style sealing element with a lip oriented toward a backup ring, the backup ring forcing the lip in a radially outward direction when the backup ring is moved against the lip by the slip ring.

23. The method as recited in claim 21, wherein locating an elastomeric sealing element further comprises using at least one anti-extrusion ring in combination with the elastomeric sealing element.

* * * * *